United States Patent [19]

Kuwertz

[11] 4,131,068

[45] Dec. 26, 1978

[54] CATCH ARRANGEMENT FOR TOWING CIRCULATING CONVEYOR WITH SIDE CIRCUIT

[75] Inventor: Erich Kuwertz, Trippstadt, Germany

[73] Assignee: psb-Pfalzstahlbau GmbH, Pirmasens, Germany

[21] Appl. No.: 795,120

[22] Filed: May 9, 1977

[30] Foreign Application Priority Data

May 14, 1976 [DE] Fed. Rep. of Germany ..... 2621411

[51] Int. Cl.[2] ..... B61J 3/04

[52] U.S. Cl. ..... 104/172 S; 104/250

[58] Field of Search ..... 104/89, 172 C, 172 S, 104/178, 250

[56] References Cited

U.S. PATENT DOCUMENTS

| | | | |
|---|---|---|---|
| 3,079,872 | 3/1963 | Birkhead | 104/172 S |
| 3,088,419 | 5/1963 | Bishop | 104/178 |
| 3,180,279 | 4/1965 | Thibault | 104/89 |
| 3,712,241 | 1/1973 | Kowertz | 104/103 |
| 3,812,787 | 5/1974 | Kling | 104/172 S |
| 4,031,829 | 6/1977 | Bell et al. | 104/172 S |

FOREIGN PATENT DOCUMENTS

| | | | |
|---|---|---|---|
| 1296098 | 5/1969 | Fed. Rep. of Germany | 104/172 S |

*Primary Examiner*—Albert J. Makay
*Assistant Examiner*—Carl Rowold
*Attorney, Agent, or Firm*—Orville N. Greene; Frank L. Durr

[57] ABSTRACT

In devices, such as overhead conveyors which have a main track and one or more spur tracks where carriers hold objects to be treated at the spur track stations, the carriers are towed or pushed along the main track by a chain tow means running in a guide which parallels the main track and are switched to the spur tracks for treatment. To save on costs, the spur tracks usually have an inclined portion so that the carriers move thereon to a treating station by gravity once they have been disconnected and switched from the main track. Here pusher means are provided on the tow chain to push the carriers out of the area of the switching zone, to thereby avoid collision with oncoming carriers and to push the switched carriers far enough that the force of gravity takes effect to cause the carriers to continue their movement.

2 Claims, 3 Drawing Figures

Figure 1:
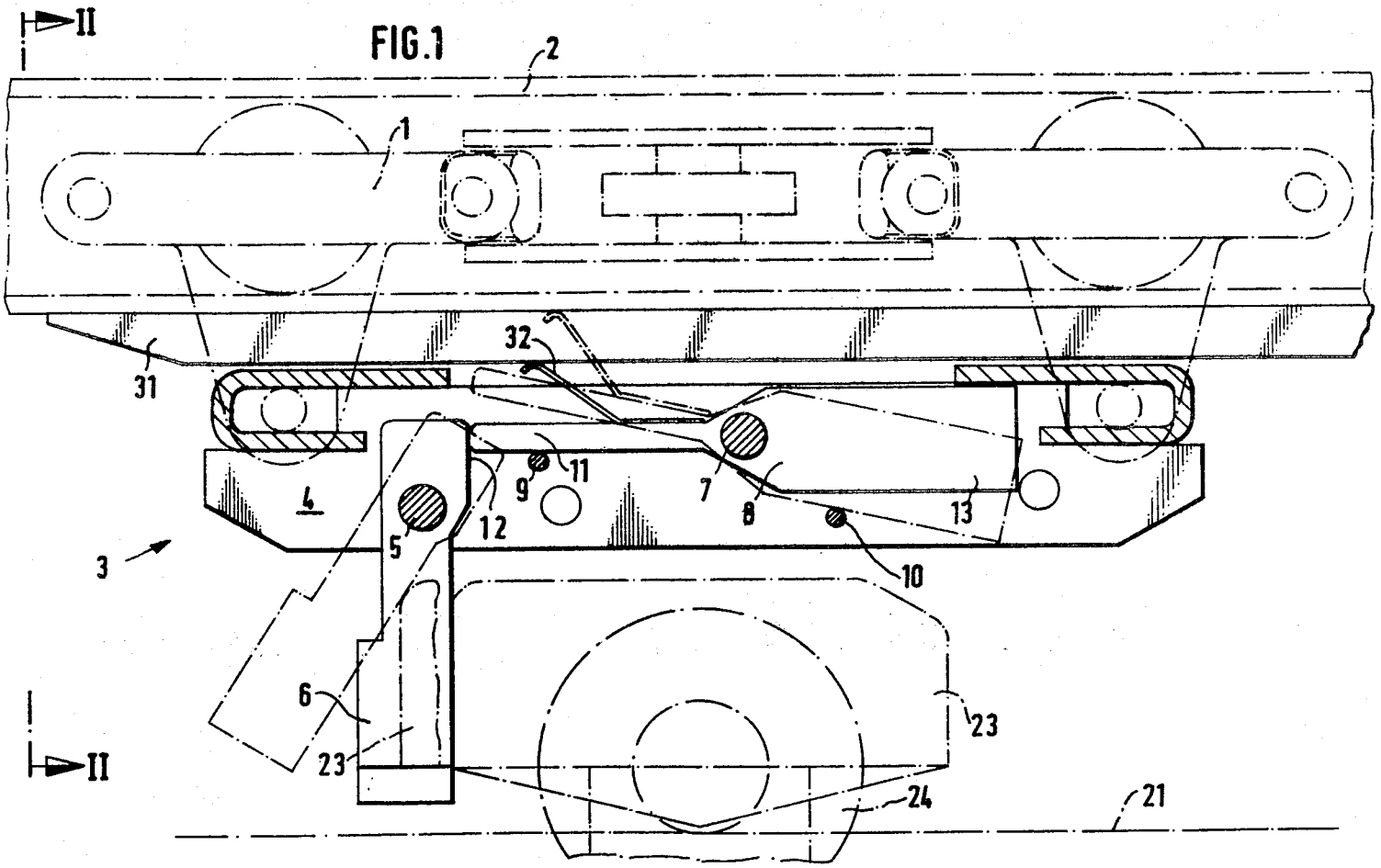

1
2
3
4
5
6
7
8
9
10
11
12
13
21
23
23
24
31
32
II
II

CATCH ARRANGEMENT FOR TOWING CIRCULATING CONVEYOR WITH SIDE CIRCUIT

The invention concerns a catch arrangement for circuit tow conveyors which have one or more secondary or spur tracks in addition to the main track, especially the so-called overhead coveyors, which serve, e.g. for forwarding a part to be finished to an intermediate or treating station by means of a travelling carrier. Between the main track and the spur tracks, suitable switches are provided which permit the passage of the carriers from the rails of the main track to those of a spur track. There must be provided, further, however, towing means in the area of these switches and also of the spur track in order to guarantee a movement of the carrier when it has been disconnected from the coupling apparatus of the tow chain of the main track.

There exists here the first possibility, in which the same conveying device as in the main track is employed in the spur track, since a tow chain of the same kind as that for the main track whose coupling arrangement can take over from the coupling means of the main track can be employed. This increases the cost of the total installation entirely too much. In order to attain a cost reduction, the idea of equipping the spur track with an inclined section has been employed so that the carriage there continues to run under the force of gravity. This, however, brings problems with it. What happens is that only the entering area of the secondary track is inclined so that a tow chain carriage branches off from the main track and can run off in the spur track from the area of the main track, it continues to run then, however, not as with a continuously sloped path accelerating itself up to a stud at the next stop, but comes, after a short time, to a standstill after the sloped section of the track changes over to a horizontal section. The forwarding of the carriage then takes place or is even necessary by hand whether the provided secondary track be for storage or checking or sorting purposes.

No matter what the structure of the spur track in particular is, basically the problem exists that the carrier must run off over a switch onto the spur track and so far from the main track that the carriers which follow have a free path on the main track and do not have any parts extending into the towing path to collide with carriages running on the main track. To this end, there has already been provided, shoving means arranged in the switching in the spur track, which does not increase the expense of the installation as much as would continuous pushing means, but still shows an essential addition in cost. Such an arrangement to be considered is e.g. U.S. Pat. No. 3,048,123. If one does not make allowance for this increase in price, the only inclined tracks in the spur track are provided for, there remains, as already explained, as a general rule, that the carrier released in the forward drive from the coupling means of the main track, remains in the switching area because it has not proceeded far enough onto the inclined track area. This can only happen when the travelling carriage, after disconnection from the coupling means, has sufficient energy which in most cases is not imparted thereto. Means must also be provided, which are not as expensive as an additional forwarding means, which however will take care that the travelling carriage always reaches so far on the inclined track area that it continues under the influence of gravity.

A catch means is also shown in U.S. Pat. No. 3,889,606 by which the fixed part of a coupling means was arranged on the tow chain and the movable part on the carrier. This stipulates a proportionately greater expense. There are, as a general rule, in such a towing circuit conveyor, many more carriers on hand than there are coupling means on the tow chain of the main track. Besides the sensitive movable parts of the coupling means will much more likely be exposed to possible harm if they are provided on the carrier, than when they are found on the tow chain. For the manufacture of a coupling connection between the posterior area of the carrier and a fixed part fastened on the tow chain, a peg which ascends on a roll fastened to its lower and to a release bar is pushed upwards in a guide. It then reaches a position in which it attains an engagement with a fixed catch finger on the tow chain. Besides the coupling arrangement, there is provided usually a coupling contrivance arranged on a previous carriage. This previous carriage is equipped with two pivotable coupling jaws which likewise can reach in its turn, into engagement with the fixed catch finger on the tow chain. The whole arrangement is expensive and accident prone.

A similar arrangement is shown in French Pat. No. 1,572,870. Here, the tow chain with its fixed catch finger is merely brought into engagement with the movable part on the posterior end of the travelling carriage by shoving upwardly, not in a guide, but by means of a side lever pivoting about a swivelling point. Also, here a roll is provided on the lower end of the movable coupling part which rises and lifts the coupling part so that it reaches into engagement with the catch finger on the tow chain. The usual coupling means at the anterior end of the travelling carriage corresponds essentially to that of the previously discussed U.S. Patent.

This invention is accordingly based on the proposition, to provide a tow circuit conveyor with a main track and a spur or auxiliary track and carriers with drive assemblies for rolling on the tracks on the anterior and posterior ends of the carriers, wherein coupling means for exerting a forwarding force is provided between the tow chain of the main track and the carrier, furthermore switching between the main track and the spur track and in the starting zone of the inclined launching stretch of the spur track are provided, finally stationary, disconnecting bars are arranged in the switching zone which cooperate with the coupling means that are provided in exchange with said usual coupling means to take care, that without the insertion of additional forwarding or pushing means in the spur track or in the switching zone, the carrier, (to a branch in a complete spur track) is moved out of the pushing ranges of the carriers in the main track and is shoved so far into the discharge stretch of the spur track that it continues automatically. Beyond that, the coupling means on the carriers should be constructed as simple as possible, should also consist only of a fixed part while the movable part of the coupling means on the tow chain should operate only through the force of gravity and by the mutual cooperation of this movable part of the coupling means with the fixed part on the travelling carriage, the most favorable force-and frictional-ratio should be sought.

The invention solves these problems through a catch arrangement starting from the just described construction so that not only the known part of the usual coupling means in the known way is provided, but also the movable part is provided as a modification thereof with disconnecting rod for the cooperative coupling means arranged on the tow chain which, furthermore, is arrestable in its vertical position through the operation of a locking lever and has a catch finger to release it from its arrestable position, which cooperates with a stationary (fixed) part of the anterior and posterior ends of the carrier wherein the locking lever is formed with a double arm and with a counter-weight on one arm and furthermore is equipped with an actuating element that cooperates with releasing means provided in the switching zone.

The actuating element on the locking lever is very satisfactory when formed as a leaf spring.

The additional catch arrangement in variation with the usual catch arrangement operates also only in the switch zone, while the carriers are taken along in the main track with the usual and known coupling means on the tow chain. The new catch arrangement serves thus only for locking on from the main circuit into the spur circuit. The carriers are held simply, they have only the fixed part of the coupling means. The movable part of the coupling means fares as well for the usual as for the coupling means of the invention. The mechanics of the movable part on the tow chain is such that it is pivoted in a simple way under the influence of gravity. In particular, no unfavorable force can appear between the movable catch finger on the tow chain and the fixed coupling means on the carriers since the catch finger, by passing over the carrier can be pivoted opposite to the feed direction from its fixed coupling means part and can be easily slid away over the coupling means portion of the carriage.

Further advantages of the invention and details of the same will obvious from the following description of the schematic embodiment thereof shown by way of example in the accompanying drawing:

In the drawings:

FIG. 1 shows the supplemental catch arrangement in side view and

Figure 2:
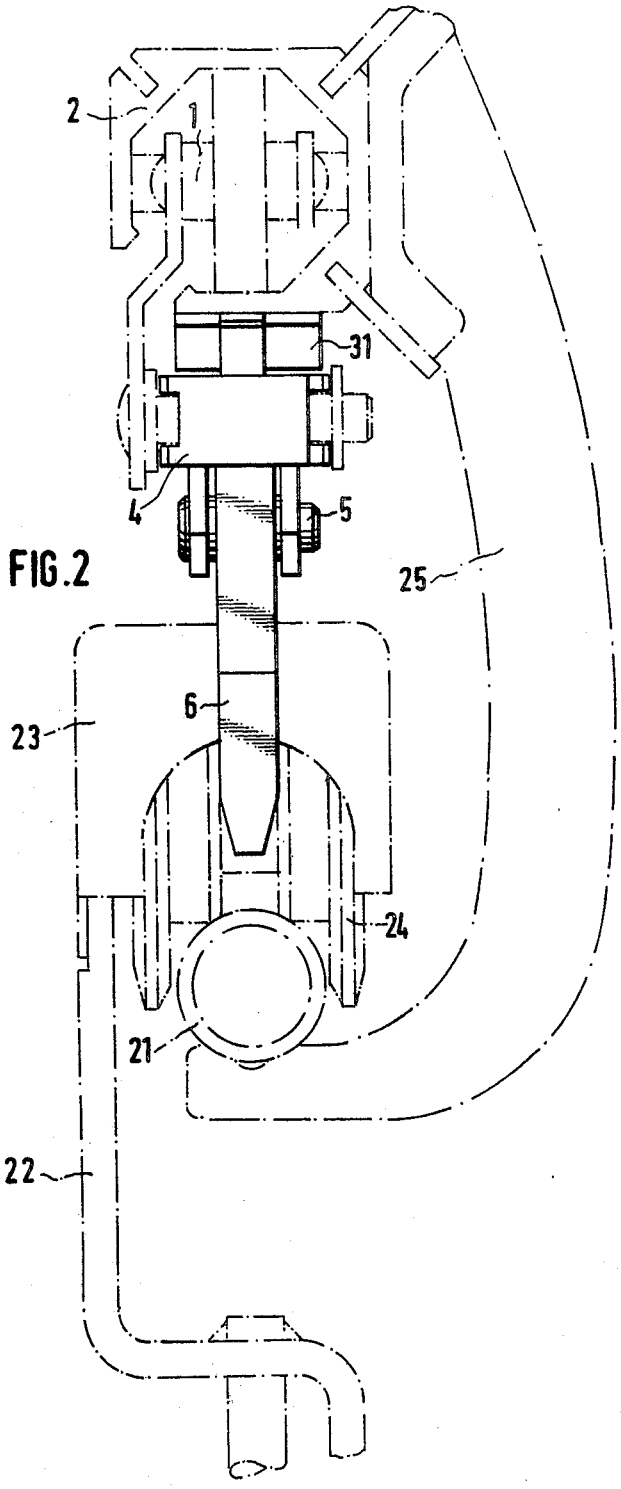

FIG. 2 reproduces front view taken on line II — II of FIG. 1.

Figure 3:
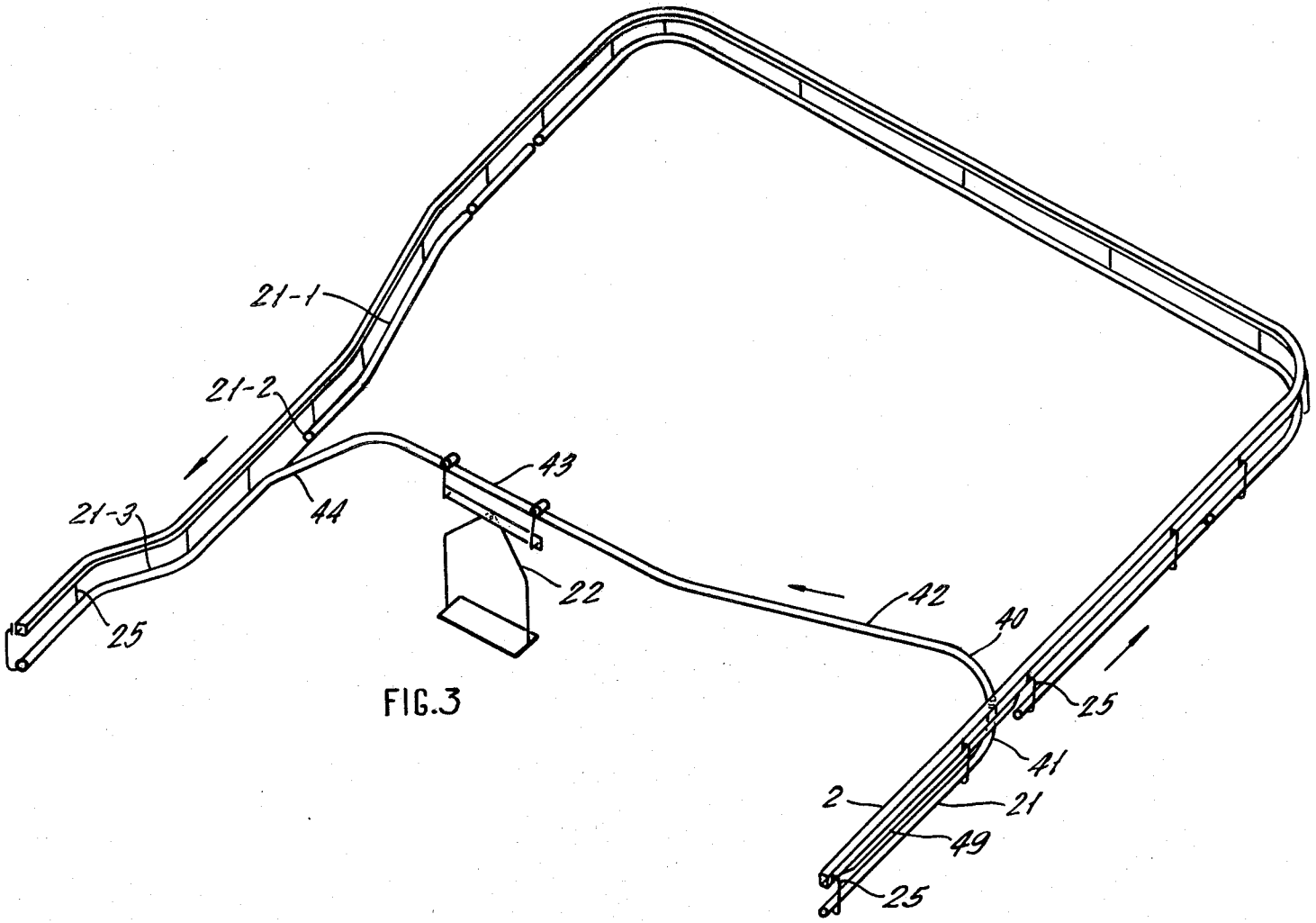

FIG. 3 is a perspective diagrammatic showing of a portion of a track system embodying a spur track in which the present invention is employed.

The essential portion of a typical towing system in which the device of the present invention is useful, is shown diagrammatically on a reduced scale in FIG. 3. The main running rail, or track 21, for the carriage 22 is connected to the guide 2 for the chain drive 1 at a series of places by means of the brackets 25. A first spur track 40 is connectible to the main track 21 by means of switch 41. The chain drive travels in an endless path (the left hand end of which is not shown) in a counterclock wise direction, as indicated by the arrows. The spur track 40 has a downwardly inclined portion 42 and a horizontal portion 43 and is connectible again to the main rail 21 by means of switch 44. The main track may be provided with a downwardly inclined section 21-1, a horizontal section 21-2, and an upwardly inclined section 21-3, so that the horizontal section 21-2 is level with that horizontal section 43 of the spur track 40. On the right hand side of the guide 2, just before switch 41 is reached, a mechanical means such as the ledge 49 is provided which is adapted to cooperate with means in the coupling device, in a known way, to release the coupling of the tow chain to the carriage as the carriage approaches the switching area.

On a tow chain 1 in a chain guide track 2, the usual coupling means are provided in the known manner. In succession with the latter, additional catch means are arranged on the chain which consist essentially of a gudgeon 5 extending horizontally from a housing 4 and transversely to the feed direction with a catch finger 6 and a likewise transversely directed gudgeon 7 around which a locking lever 8 is pivotally arranged. The locking lever 8 is limited in its freedom of movement by two studs 9 and 10. The end 11 of the locking lever 8 cooperates with the front side 12 of the catch finger 6. The opposite end 13 of locking lever 8 is formed as a counterweight.

The catch finger 6 cooperates with the rigid part of a coupling means on a carrier 22 riding on the rails 21 of a hanging track, e.g., with the dome 23 of this travelling carriage 22 which is equipped with rollers 24. Not only chain guide rails 2, but also runway rail 21 is fastened on bracket 25.

In each switching range, unlocking means 31 are provided e.g., fastened on the chain guide track 2 which cooperates with an actuating element 32 on the locking lever 8.

The usual coupling means (not shown) sets the carriage 22 in motion in the feed direction in the known way. If now the carriage 22 is to be diverted from the feed direction of the main track or orbit through a switch, the operating connection between the tow chain 1 and carriage 22 is released, the carriage under the influence of its mass, still proceeds for a short distance, which as a general rule is not sufficient to bring it out completely from the feed range of the main track.

On the following catch device 4, when the activating element 32 of the locking lever 8 runs on the edge of 31, and the end 11 of locking lever 8 is pressed down as shown in full lines in FIG. 1, thereby arresting the catch finger 6 in its vertical position so that the catching means 4 can grasp carriage 22. The catch finger 6 comes into contact with the back side of the dome 23 from behind and pushes the carriage entirely away from the main track onto the spur track until the catch finger 6 is disconnected from behind the mechanism.

But here, the carriage has already reached a position in which it continues to run under the influence of the force of gravity on the inclined landing space in the starting range of the spur circuit. A collision with a following carriage remaining in the main circuit is avoided.

The parts employed in the coupling means on the chain are simple and appropriate in large part in development and designing of those parts in the usual coupling means so that no special fabrication is necessary here. The mode of operation is quiet and low wearing, since the catch finger as well as the locking lever are freely pivoted around their pivoting axes. The interpositioning of a springy actuating element 32 likewise influences favorably the mode of operation of the coupling means.

I claim:

1. Catch mechanism for a tow conveyor of the type having a main track, a plurality of carriages for objects to be treated running on the main track, a tow chain and track for the same positioned above and paralleling said main track for moving carriers along said main track in the feed direction and switching means between the main track and the spur track to switch carriers from the main track to the spur track, a portion of said spur track close to said main track being downwardly inclined so that carriers started thereon continue to move along the spur track by gravity, and means to release carriers from the chain means in the area of a switch, the improved means to move a released carrier from the switching region of the main track comprising housing means connected to and suspended from the tow chain, said housing means comprising a first gudgeon in said housing extending transversely with respect to the feed direction in the rear of said housing with respect to the feed direction, a pivotable finger catch means mounted on said gudgeon so as to freely pivot thereabout and to normally extend vertically with its lower end in the path of a carrier, a second gudgeon mounted in the forward portion of said housing extending transversely with respect to the feed direction, double-arm lever means pivotally mounted on said second gudgeon, a first arm of said lever extending in the direction toward said finger catch means and the second arm thereof being weighted and extending in the direction away from said finger catch means whereby said first arm of said lever is normally pivoted upwardly by the force of the second weighted lever arm, actuating means on said first arm of said lever, a contact means in the path of the chain guide means in the region of the switch to cooperate with said actuating means to push said first arm of the lever down to lock the finger of the catch means in its vertical locked position, said finger means in its vertical position cooperating with fixed means on the carrier to move the carrier out of the switching area a sufficient distance for the carrier to continue moving by gravity on said inclined portion of the spur track.

2. The catch mechanism as claimed in claim 1 wherein said actuating means on the first arm of said lever comprises a spring, said housing containing an opening permitting the spring to contact said contact means.

* * * * *